US009293012B2

(12) United States Patent
Lark

(10) Patent No.: US 9,293,012 B2
(45) Date of Patent: Mar. 22, 2016

(54) INDIVIDUAL BALL DRAW KENO

(71) Applicant: IGT, Las Vegas, NV (US)

(72) Inventor: David R. Lark, Reno, NV (US)

(73) Assignee: IGT, Las Vegas, NV (US)

( * ) Notice: Subject to any disclaimer, the term of this patent is extended or adjusted under 35 U.S.C. 154(b) by 183 days.

(21) Appl. No.: 13/957,168

(22) Filed: Aug. 1, 2013

(65) Prior Publication Data

US 2015/0038209 A1 Feb. 5, 2015

(51) Int. Cl.
*G07F 17/32* (2006.01)

(52) U.S. Cl.
CPC ..... *G07F 17/329* (2013.01)

(58) Field of Classification Search
CPC ..... G07F 17/3286
USPC ..... 463/17, 18
See application file for complete search history.

(56) References Cited

U.S. PATENT DOCUMENTS

| | | | |
|---|---|---|---|
| 4,033,588 | A | 7/1977 | Watts |
| 4,611,811 | A | 9/1986 | Haase |
| 4,661,906 | A | 4/1987 | DiFrancesco et al. |
| 4,711,454 | A | 12/1987 | Small |
| 4,747,600 | A | 5/1988 | Richardson |
| 4,775,155 | A | 10/1988 | Lees |
| 4,798,387 | A | 1/1989 | Richardson |
| 4,875,686 | A | 10/1989 | Timms |
| 5,005,840 | A | 4/1991 | Schwartz |
| 5,043,887 | A | 8/1991 | Richardson |
| 5,046,737 | A | 9/1991 | Fienberg |
| 5,072,381 | A | 12/1991 | Richardson et al. |
| 5,100,139 | A | 3/1992 | Di Bella |
| 5,116,049 | A | 5/1992 | Sludikoff et al. |
| 5,158,293 | A | 10/1992 | Mullins |
| 5,242,163 | A | 9/1993 | Fulton et al. |
| 5,351,970 | A | 10/1994 | Fioretti |
| 5,401,024 | A | 3/1995 | Simunek |
| 5,419,592 | A | 5/1995 | Stuart |
| 5,482,289 | A | 1/1996 | Weingardt |
| 5,569,083 | A | 10/1996 | Fioretti |
| 5,586,937 | A | 12/1996 | Menashe |
| 5,628,684 | A | 5/1997 | Boudec et al. |
| 5,639,089 | A | 6/1997 | Matsumoto et al. |
| 5,647,798 | A | 7/1997 | Falciglia |
| 5,651,735 | A | 7/1997 | Baba |
| 5,679,077 | A | 10/1997 | Pocock et al. |
| 5,687,971 | A | 11/1997 | Khaladkar |
| 5,718,631 | A | 2/1998 | Invencion |
| 5,727,786 | A | 3/1998 | Weingardt |

(Continued)

FOREIGN PATENT DOCUMENTS

| | | |
|---|---|---|
| EP | 1 513 116 | 3/2005 |
| WO | WO 2004/014502 | 2/2004 |

(Continued)

*Primary Examiner* — Jason Skaarup
(74) *Attorney, Agent, or Firm* — Neal, Gerber & Eisenberg LLP

(57) ABSTRACT

A method of providing a keno game includes, but is not limited to any of the combination of: displaying a keno board having a first predetermined number of keno board spots; receiving a player selection of a second predetermined number of keno board spots; selecting a first plurality of drawn balls; and calculating a player award in part based on data associated with the first plurality of drawn balls, wherein at least two of the drawn balls in the first plurality of drawn balls are duplicates.

20 Claims, 8 Drawing Sheets

(56) References Cited

U.S. PATENT DOCUMENTS 5,743,526 A 4/1998 Inoue
5,755,619 A 5/1998 Matsumoto et al.
5,779,545 A 7/1998 Berg et al.
5,800,269 A 9/1998 Holch et al.
5,813,911 A 9/1998 Margolin
5,823,534 A 10/1998 Banyai
5,848,932 A 12/1998 Adams
5,857,911 A 1/1999 Fioretti
5,871,398 A 2/1999 Schneier et al.
5,909,875 A 6/1999 Weingardt
5,935,001 A 8/1999 Baba
5,935,002 A 8/1999 Falciglia
5,945,655 A 8/1999 Gilgeous et al.
6,015,346 A 1/2000 Bennett
6,017,032 A 1/2000 Grippo et al.
6,024,640 A 2/2000 Walker et al.
6,033,306 A 3/2000 De Souza et al.
6,079,711 A 6/2000 Wei et al.
6,089,976 A 7/2000 Schneider et al.
6,089,978 A 7/2000 Adams
6,099,407 A 8/2000 Parker et al.
6,102,400 A 8/2000 Scott et al.
6,146,272 A 11/2000 Walker et al.
6,168,521 B1 1/2001 Luciano et al.
6,174,235 B1 1/2001 Walker et al.
6,183,361 B1 2/2001 Cummings et al.
6,186,892 B1 2/2001 Frank
6,210,276 B1 4/2001 Mullins
6,210,279 B1 4/2001 Dickinson
6,220,961 B1 4/2001 Keane et al.
6,241,606 B1 6/2001 Riendeau et al.
6,250,685 B1 6/2001 Walker et al.
6,257,980 B1 7/2001 Santini, Jr.
6,280,325 B1 8/2001 Fisk
6,283,855 B1 9/2001 Bingham
6,309,298 B1 10/2001 Gerow
6,309,300 B1 10/2001 Glavich
6,315,290 B1 11/2001 Roethel et al.
6,315,291 B1 11/2001 Moody
6,325,716 B1 12/2001 Walker et al.
6,336,862 B1 1/2002 Byrne
6,346,043 B1 2/2002 Colin et al.
6,358,151 B1 3/2002 Enzminger et al.
6,364,313 B1 4/2002 Moody
6,364,767 B1 4/2002 Brossard et al.
6,368,213 B1 4/2002 McNabola
6,368,214 B1 4/2002 Luciano
6,368,218 B2 4/2002 Angell, Jr.
6,398,644 B1 6/2002 Perrie et al.
6,398,645 B1 6/2002 Yoseloff
6,398,646 B1 6/2002 Wei et al.
6,402,614 B1 6/2002 Schneier et al.
6,419,583 B1 7/2002 Crumby et al.
6,425,823 B1 7/2002 Byrne
6,454,648 B1 9/2002 Kelly et al.
6,478,677 B1 11/2002 Moody
6,482,088 B2 11/2002 Santini, Jr.
6,514,144 B2 2/2003 Riendeau et al.
6,524,184 B1 2/2003 Lind et al.
6,524,185 B2 2/2003 Lind
6,533,660 B2 3/2003 Seelig et al.
6,533,664 B1 3/2003 Crumby
6,537,150 B1 3/2003 Luciano et al.
6,565,091 B2 5/2003 Weingardt
6,569,017 B2 5/2003 Enzminger et al.
6,581,935 B1 6/2003 Odom
6,585,590 B2 7/2003 Malone
6,599,188 B2 7/2003 Hirsch et al.
6,605,001 B1 8/2003 Tarantino
6,607,440 B2 8/2003 Santini, Jr.
6,609,973 B1 8/2003 Weiss
6,645,071 B2 11/2003 Perrie et al.
6,645,072 B1 11/2003 Kellen
6,656,044 B1 12/2003 Lewis
6,656,045 B2 12/2003 Wei et al.
6,672,960 B1 1/2004 B-Jensen
6,676,516 B2 1/2004 Baerlocher et al.
6,722,655 B1 4/2004 Camero
6,722,981 B2 4/2004 Kaminkow et al.
6,722,982 B2 4/2004 Kaminkow et al.
6,755,738 B2 6/2004 Glasson et al.
6,755,739 B2 6/2004 Santini, Jr.
6,761,632 B2 7/2004 Bansemer et al.
6,764,397 B1 7/2004 Robb
6,780,108 B1 8/2004 Luciano et al.
6,783,457 B2 8/2004 Hughs-Baird et al.
6,802,776 B2 10/2004 Lind et al.
6,824,465 B2 11/2004 Luciano, Jr.
6,832,956 B1 12/2004 Boyd et al.
6,835,138 B2 12/2004 Baeg
6,840,858 B2 1/2005 Adams
6,910,962 B2 6/2005 Marks et al.
6,981,635 B1 1/2006 Hughs-Baird et al.
7,040,984 B2 5/2006 Mead
7,160,186 B2 1/2007 Cuddy et al.
7,160,188 B2 1/2007 Kaminkow et al.
7,182,689 B2 2/2007 Hughs-Baird et al.
7,235,011 B2 6/2007 Randall et al.
7,258,608 B2 8/2007 Khal
7,273,415 B2 9/2007 Cregan et al.
7,303,469 B2 12/2007 Kaminkow
7,306,519 B2 12/2007 Baerlocher
7,314,409 B2 1/2008 Maya et al.
7,399,227 B2 7/2008 Michaelson et al.
7,544,129 B2 6/2009 Baerlocher
7,682,241 B2 3/2010 Baerlocher
7,824,257 B2 11/2010 Jubinville et al.
7,901,282 B2 3/2011 Cannon
8,025,561 B2 9/2011 Reddicks et al.
8,814,651 B1 8/2014 Humphrey et al.
2002/0045472 A1 4/2002 Adams
2002/0052231 A1 5/2002 Fioretti
2002/0094859 A1 7/2002 Hirsch et al.
2002/0098882 A1 7/2002 Lind et al.
2002/0098883 A1 7/2002 Packes et al.
2002/0111207 A1 8/2002 Lind et al.
2002/0111214 A1 8/2002 Lind et al.
2002/0113369 A1 8/2002 Weingardt
2002/0117803 A1 8/2002 Weingardt
2002/0137562 A1 9/2002 Malone
2002/0155877 A1 10/2002 Enzminger et al.
2002/0160827 A1* 10/2002 Slomiany et al. ..... 463/16
2002/0169018 A1 11/2002 Schneier et al.
2002/0177478 A1 11/2002 Glasson et al.
2003/0017867 A1 1/2003 Dekeller
2003/0073480 A1* 4/2003 Thomas et al. ..... 463/18
2003/0127793 A1 7/2003 Adams
2003/0144050 A1 7/2003 Keaton et al.
2003/0171986 A1 9/2003 Itkis et al.
2003/0178771 A1 9/2003 Banyai
2003/0181234 A1 9/2003 Falciglia, Sr.
2003/0193136 A1 10/2003 Walker et al.
2003/0195032 A1 10/2003 Enzminger et al.
2004/0009806 A1 1/2004 Odom
2004/0048647 A1 3/2004 Lind et al.
2004/0053669 A1 3/2004 Gerrard et al.
2004/0106445 A1 6/2004 Perrie et al.
2004/0121834 A1 6/2004 Libby et al.
2004/0130096 A1 7/2004 Duhamel
2004/0152499 A1 8/2004 Lind et al.
2004/0166920 A1 8/2004 Boyd et al.
2004/0176169 A1 9/2004 Lind et al.
2004/0178579 A1 9/2004 Lowell et al.
2004/0204225 A1 10/2004 Campo et al.
2004/0214626 A1 10/2004 Lind et al.
2004/0235555 A1 11/2004 Yarbrough et al.
2004/0242310 A1 12/2004 Perkins
2004/0251628 A1 12/2004 Kilby
2004/0266509 A1 12/2004 Bennett et al.
2005/0054404 A1 3/2005 Baerlocher
2005/0054415 A1 3/2005 Kaminkow et al.
2005/0059449 A1 3/2005 Yarbrough
2005/0059461 A1 3/2005 Ching et al.
2005/0059467 A1 3/2005 Saffari et al.

(56) References Cited

U.S. PATENT DOCUMENTS

| | | | | |
|---|---|---|---|---|
| 2005/0059468 | A1 | 3/2005 | Cannon | |
| 2005/0059469 | A1 | 3/2005 | Gail et al. | |
| 2005/0059470 | A1 | 3/2005 | Cannon | |
| 2005/0059471 | A1 | 3/2005 | Cannon | |
| 2005/0064932 | A1 | 3/2005 | Cannon | |
| 2005/0075161 | A1 | 4/2005 | McGlone et al. | |
| 2005/0096119 | A1 | 5/2005 | Lind et al. | |
| 2005/0096123 | A1 | 5/2005 | Cregan et al. | |
| 2005/0101370 | A1 | 5/2005 | Lind et al. | |
| 2005/0101387 | A1 | 5/2005 | Wolf | |
| 2005/0119042 | A1 | 6/2005 | Chamberlain et al. | |
| 2005/0130730 | A1 | 6/2005 | Lind et al. | |
| 2005/0148382 | A1 | 7/2005 | Fox | |
| 2005/0164771 | A1 | 7/2005 | Lind et al. | |
| 2005/0164772 | A1 | 7/2005 | Lind et al. | |
| 2005/0164773 | A1 | 7/2005 | Lind et al. | |
| 2005/0167916 | A1 | 8/2005 | Banyai | |
| 2005/0187014 | A1 | 8/2005 | Saffari et al. | |
| 2005/0192081 | A1 | 9/2005 | Marks et al. | |
| 2005/0227753 | A1 | 10/2005 | Luciano, Jr. | |
| 2005/0255906 | A1 | 11/2005 | Lind et al. | |
| 2006/0084490 | A1 | 4/2006 | Khal | |
| 2006/0178196 | A1* | 8/2006 | Thomas | 463/18 |
| 2006/0189375 | A1 | 8/2006 | Dodge | |
| 2006/0246977 | A1 | 11/2006 | Cannon | |
| 2007/0010308 | A1* | 1/2007 | Duhamel | 463/16 |
| 2007/0021185 | A1 | 1/2007 | Walker et al. | |
| 2007/0052172 | A1* | 3/2007 | Dargue | 273/292 |
| 2007/0117611 | A1 | 5/2007 | Dodge | |
| 2007/0135204 | A1* | 6/2007 | Nicely | 463/17 |
| 2007/0173313 | A1 | 7/2007 | Bienvenue | |
| 2008/0102952 | A1 | 5/2008 | Walker et al. | |
| 2008/0113742 | A1* | 5/2008 | Amos et al. | 463/20 |
| 2008/0254894 | A1 | 10/2008 | Michaelson et al. | |
| 2009/0075714 | A1* | 3/2009 | Meyer et al. | 463/19 |
| 2009/0075715 | A1 | 3/2009 | Coleman et al. | |
| 2009/0197664 | A1 | 8/2009 | Schultz | |
| 2010/0004046 | A1* | 1/2010 | Brunelle | 463/18 |
| 2010/0120489 | A1 | 5/2010 | Meyer | |
| 2010/0285862 | A1* | 11/2010 | Pau et al. | 463/20 |
| 2011/0028201 | A1 | 2/2011 | Warner et al. | |
| 2013/0178271 | A1 | 7/2013 | Aponte et al. | |
| 2014/0248935 | A1* | 9/2014 | Williams et al. | 463/19 |
| 2014/0274275 | A1* | 9/2014 | DeFrance et al. | 463/18 |

FOREIGN PATENT DOCUMENTS

| | | |
|---|---|---|
| WO | WO 2004/070551 | 8/2004 |
| WO | WO 2004/105903 | 12/2004 |
| WO | WO 2005/060567 | 7/2005 |
| WO | WO 2005/072096 | 8/2005 |
| WO | WO 2005/079142 | 9/2005 |

* cited by examiner

INDIVIDUAL BALL DRAW KENO

BACKGROUND

The present disclosure relates generally to wager-based games and more particularly to keno games. A keno game typically displays to a player a keno board with eighty numbered selection spots. A player wagers by selecting six spots on the keno board. Next, twenty balls are drawn from eighty possible balls, with each ball having a number between one and eighty.

The player is paid based on matches found between the drawn balls and the six player-selected spots on the keno board. For example, the player may have selected numbers 5, 21, 34, 36, 49, and 71 of which 5 and 21 match the ball drawn by the keno game. A paytable may dictate the payout amount that is due to the player depending on the number of matches detected. For example, a paytable may indicate that if there are four hits, then the payout amount is seven points.

Keno games can be played in gaming casinos and other locations that feature electronic keno gaming machines. Keno players can also play keno games online using a variety of computing devices such as smart phones.

SUMMARY

A method of providing a keno game includes, but is not limited to any of the combination of: displaying a keno board having a first predetermined number of keno board spots; receiving a player selection of a second predetermined number of keno board spots; selecting a first plurality of drawn balls; and calculating a player award in part based on data associated with the first plurality of drawn balls, wherein at least two of the drawn balls in the first plurality of drawn balls are duplicates.

An electronic device for playing a keno game including a display configured to display the keno game to a player having a keno board with a first predetermined number of keno board spots, a user-input panel and a game controller having one or more data processors and one or more storage devices storing instructions that, when executed by the one or more data processors, cause the one or more data processors to perform operations comprising: receiving a player selection of a second predetermined number of keno board spots; selecting a first plurality of drawn balls from a set of available drawing balls having a third predetermined number of balls, wherein after a ball is selected from the set of available drawing balls, the ball remains in the set of available balls for further drawings.

A computer-readable storage medium having machine instructions stored therein, the instructions being executable by a processor to cause the processor to perform operations including displaying a keno board having a first predetermined number of keno board spots; receiving a player selection of a second predetermined number of keno board spots; selecting a first plurality of drawn balls from a set of available drawing balls having a third predetermined number of balls, wherein after a ball is selected from the set of available drawing balls, the ball remains in the set of available balls for further drawings.

BRIEF DESCRIPTION OF THE DRAWINGS

The details of one or more implementations are set forth in the accompanying drawings and the description below. Other features, aspects, and advantages of the disclosure will become apparent from the description, the drawings, and the claims, in which:

DETAILED DESCRIPTION

Figure 1:
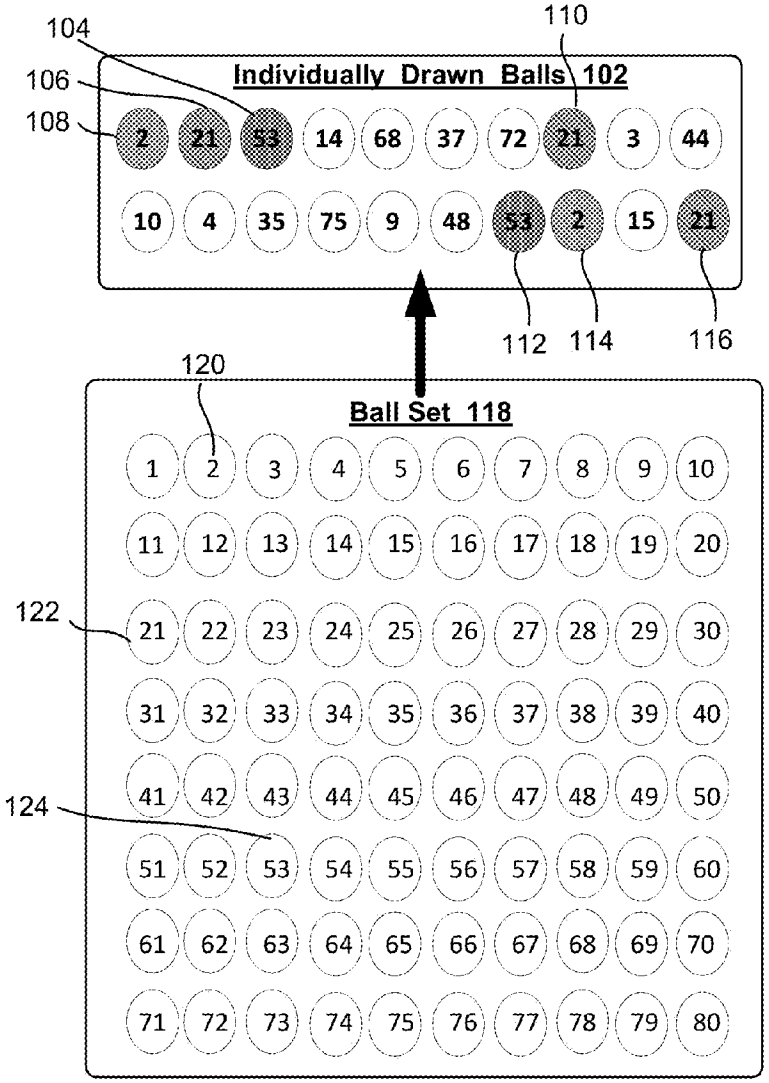
FIG. 1 is an illustration of selecting drawn balls during a keno game including duplicate balls, in an accordance with an example implementation.

Numerous specific details may be set forth below to provide a thorough understanding of concepts underlying the described embodiments. It may be apparent, however, to one skilled in the art that the described embodiments may be practiced without some or all of these specific details. In other instances, some process steps have not been described in detail in order to avoid unnecessarily obscuring the underlying concept.

During a keno game, the player may select and mark spots on a keno board shown to the player on an electronic display of a gaming machine or the player's computing device. The player selected keno board spots are numbers selected by the player, which are a sub-set of the total set of available numbers. For example, the total set of available numbers may include eighty unique numbers (i.e., numbers from one to eighty) and the sub-set of numbers selected by the player may be six numbers. The set of available numbers may be shown on the keno board as numbered balls, numbered squares or any other visual representation. Once the player selects the sub-set of numbers, the keno game randomly selects a set of numbers from the available set of numbers. For example, twenty randomly selected numbers may be selected and displayed to the player. The randomly selected numbers may be shown to the player as "ball drops". After each number in the set of numbers is randomly selected, it may be removed from the set of available numbers and may not be available to be selected again until another keno game. When duplicates are allowed in the set of drawn numbers, each randomly selected number is not removed from the available set of numbers and is available to be subsequently selected again during the same keno game.

According to various embodiments disclosed herein, a keno game may allow for a set of drawn balls to include duplicate drawn balls for which the player may be awarded. In some embodiments, each drawn ball is drawn during the keno game from a separate set of eighty balls. In other embodiments, when a ball is drawn during the drawn keno game, that ball is put back into the pool of possible numbers to be drawn for the remaining balls, restoring the pool to a new complete set of eighty balls. As a result, the set of drawn balls that are drawn during the keno game may have duplicate balls. For example, two balls numbered "4" may be drawn. This is different from a traditional keno game in which twenty drawn balls are selected from a single set of eighty balls, and the drawn balls do not include duplicate balls.

During the keno game, the number of duplicate balls that are drawn may be used as a pay category feature. Accordingly, the player may be paid in accordance with the traditional paytable(s) that look at the number of hits as well as using one or more duplicate paytables which may indicate payout amounts for various numbers of duplicates. For example, a duplicate paytable may indicate that when four duplicates are found, a predetermined number of points may be paid to the player (e.g., 10 points). The duplicate paytable may be a progressive paytable or a standard paytable. In addition to or instead of the actual pay amounts, the player may be awarded for duplicates balls being drawn in other forms or payment (e.g., multipliers for the base game, additional free balls, additional free draws, etc.).

FIG. 1 illustrates twenty balls being individually drawn from a set of eighty balls. A set of individually drawn balls 102 is shown to include twenty balls with each ball displaying a number between one and eighty. The individually drawn balls 102 are selected from a single ball set 118. The ball set 118 includes eighty balls with each ball being numbered with a number between one and eighty. For example, a ball 120 is numbered with a number "2".

After a ball is selected from the ball set 118, the ball is "put back" into the ball set 118 so that it may potentially be selected again. In other embodiments, each individually drawn ball may be selected from a separate ball set. In these embodiments, the first of twenty balls is selected from one ball set of eighty balls, while the second ball of twenty balls is selected from another ball set of eighty balls, etc.

As shown, individually drawn balls 102 include several duplicate balls. In particular, a ball 122 labeled with number "21" was drawn three times which resulted in drawn balls 106, 110 and 116 being displayed as three duplicate balls of the twenty individually drawn balls 102. A ball 120 labeled with number "2" was drawn twice. As a result, drawn balls 108 and 114 are shown as duplicate balls each labeled with number "2". A ball 124 labeled with number "53" was drawn twice, which resulted in drawn balls 104 and 112 displaying as two duplicate balls labeled with number "53". Accordingly, the individually drawn balls 102 include two drawn balls each labeled with number "2", two drawn balls each labeled with number "53", three drawn balls each labeled with "21", and thirteen uniquely labeled drawn balls (i.e., balls labeled with numbers "14", "68", "37", "72", "3", "44", "10", "4", "35", "75", "9", "48" and "15").

Although FIG. 1 shows seven individually drawn balls (i.e., drawn balls 104-116) as having duplicate balls, any number of twenty drawn balls may have duplicates. Any ball from the ball set 118 may be drawn any number of times, up to the total number of draws. For example, a ball numbered "77" may be drawn five times, which would result in five duplicate drawn balls labeled with number "77" being shown in the individually drawn ball set 102.

The individually drawn balls 102 and the ball set 118 may be displayed to the player of the keno game on an electronic display of a gaming machine or a user computing device. For example, after the player marks spots on the keno board, the individually drawn balls may be selected and displayed to the player.

FIG. 1 illustrates the duplicate balls in the individually drawn ball set 102 as having different patterns to indicate duplicate balls. The duplicate balls may be illustrated using any patterns, colors, or other types of visualizations that would provide a visual indication of the duplicate balls. The duplicate balls having the same patterns may draw the player's attention to the duplicate balls. In some embodiments, all the balls in the individually drawn balls 102 are shown with similar visualizations. In other embodiments, the duplicate balls in the individual drawn balls 102 may be shown next to one another with additional spacing between unique drawn balls.

In some embodiments, a separate listing of detected duplicate drawn balls may be provided (not shown in FIG. 1). For example, the separate listing of detected duplicate drawn balls may display duplicate drawn balls next to each other. In another example, the separate listing of detected duplicate drawn balls may include displaying the number of duplicates next to each drawn ball that has duplicates.

Referring now to FIGS. 2A-E, illustrations 200A-E of an individual drawn ball keno game awarding the player for duplicate individually drawn balls are shown, according to one implementation. The illustrations 200A-E of the keno game can be displayed to a player on a display of a gaming machine, or on a webpage or an application installed on a computing device utilized by the player.

The illustration 200A-E of the individual drawn ball keno game include a keno board 206, which displays eighty keno board spots with each keno board spot numbered one to eighty (or any other number of spots). The player marked six spots (e.g., spot 212) on the keno board 206 including keno board spots numbered "4", "5", "14", "35", "42", and "43". As shown, the player is not allowed to mark the same keno board spot more than once. Once the player marks the six keno board spots (or any other number of keno board spots), twenty balls (or any number of balls) are drawn individually as illustrated in FIG. 1. The drawn balls may include balls that are duplicates. Although not shown, the individually drawn balls 102 may be displayed in the illustrations 200A-E of the keno game.

Figure 2A:
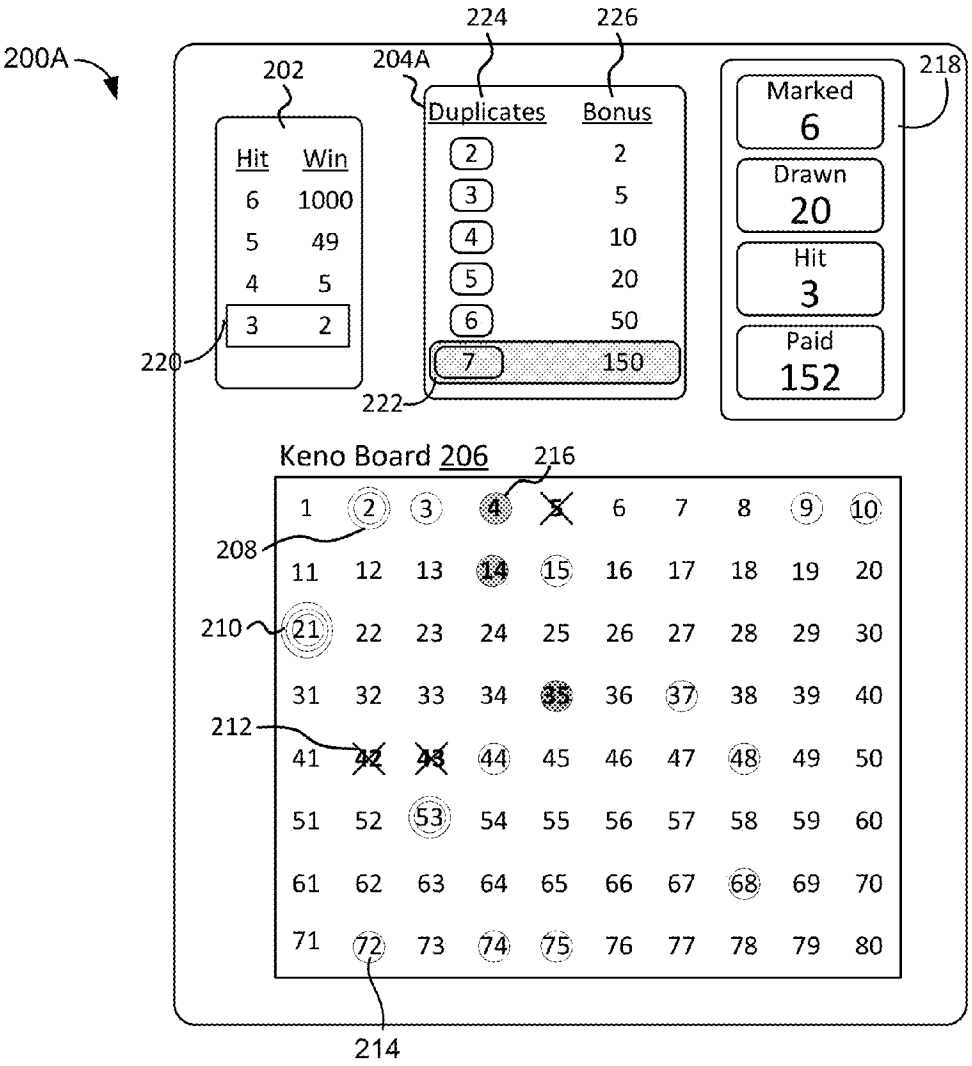
FIGS. 2A-E are illustrations of a keno game awarding a player for duplicate draws, in an accordance with an example implementation.

The drawn balls 102 are shown on the keno board 206 in FIG. 2A as circles around the corresponding keno board spots. For example, a keno board spot 214 is shown to have a single circle drawn around the number "72". The single circle drawn around the number "72" indicates that one of twenty individually drawn balls is labeled with the number "72". As illustrated, when the same ball is drawn more than once, an additional circle is drawn around the corresponding keno board spot. For example, as shown, the keno board spot 210 labeled with number "21" has three circles drawn around it, indicating that three of the individually drawn balls are labeled with number "21". Other visualizations may also be used to indicate to the player the drawn balls including duplicate drawn balls.

A match may be detected between one or more keno board spots marked by the player and the drawn balls. For example, as shown, the player marked a keno board spot labeled with number "4", and also one of the drawn ball is labeled with the number "4". In this example, the detected match between the player marking of a keno board spot and the drawn ball is indicated in FIG. 2A with the ball drawn around the number "4" being colored with a grey color. Any other visualization effect may be utilized to indicate to the player that the player's spot markings "hit" the drawn ball. For example, a separate visualization of drawn balls that are "hits" (e.g., displaying a grouping of drawn balls that are hits) may be provided.

In FIGS. 2A-E, an "X" visual indicator drawn over a keno board spot is used to provide a visual indication that the player marked this keno board spot but that no individually drawn balls matched this keno board spot. For example, as shown, the "X" visual indicators drawn over the keno board spots numbered "5", "42" and "43" indicate that those user marked spots did not match any of the drawn balls. Other types of visualizations may be used to indicate to the user which keno board spots did not match any drawn balls.

FIGS. 2A-E further illustrate a display section 202 including a paytable having two columns "hit" and "win". The "hit" column represents the number of matches or "hits" between the player marked keno board spots and the drawn balls. As shown, the paytable displays four rows under the column "hit" with hits values of 6, 5, 4, and 3. The "win" column represents the number of credits or points that are awarded to the player when a certain number of "hits" are detected. For example, when three "hits" are detected, the player is entitled to two credits or points. As shown, the more hits are detected, the higher the player's "win". When five "hits" are detected between the player selected keno board spots and drawn balls, the player is awarded forty nine points as opposed to two points for three "hits". As emphasized by a rectangle 220 around the last row of the table shown in the display section 202, three hits were detected during the keno game, which resulted in the player being awarded 2 credits.

FIGS. 2A-2E illustrate different arrangements for awarding points and other awards when the drawn balls include duplicate draws. Referring first specifically to FIG. 2A, the illustration 200A of the keno game includes a display section 204A, which illustrates a paytable for awarding the player additional points or credits when a particular number of total duplicate drawn balls is detected (e.g., the total number regardless of the particular composition of the duplicates). The paytable in the display section 204A includes a "duplicates" column 224 showing the total numbers of duplicate drawn balls. As shown on the keno board 206, the ball labeled with number "2" was drawn twice, the ball labeled with number "53" was also drawn twice, while the ball labeled with number "21" was drawn three times. Accordingly, a total of seven duplicate balls were drawn.

The paytable in the display section 204A further includes a "bonus" column displaying the "bonus" number of credits. As shown, when a total of two duplicates is detected, a bonus of two points or credits is awarded to the player. Furthermore, for three duplicate drawn balls, a bonus of five points is awarded, etc. Although the shown specific numbers of points are assigned to various numbers of total duplicates, any number of credits may be assigned to any number of duplicates. Additionally, although the paytable is shown as providing bonuses for up to seven duplicates, in practice, the paytable may provide bonuses for up to twenty duplicates (if the total number of drawn balls is twenty).

In the keno game shown, seven duplicate balls were drawn (i.e., ball "2" was drawn twice, ball "53" was drawn twice, and ball "21" drawn three times), and, as a result, the player is entitled to a bonus of one hundred and fifty credits. As emphasized by a rectangle 222 around the last row of the paytable shown in the display section 204A, a total number of seven duplicates was detected during the keno game, which resulted in the player being awarded one hundred fifty bonus credits. Accordingly, the player is awarded for the existence of duplicate drawn balls, which may in turn encourage the player to continue playing the keno game. A higher number of total number of duplicate drawn balls detected triggers a bigger bonus award.

As illustrated, a display section 218 summarizes the outcome of the keno game. The display section 218 states "Marked 6", which indicates that a total number of six keno board spots were marked or selected by the player. The display section 18 further states "Drawn 20", which means that a total number of twenty individually drawn balls were selected. A portion of the display section 218 indicates that the total number of hits between the player marked spots and the drawn balls is three (i.e., the keno board spots marked as "4", "14", and "35"). Finally, the display section 218 indicates the total number of points or credits earned by the player during the current round of the keno game (e.g., 152 in FIG. 2A). The total number of credits earned by the player are calculated by adding two points which resulted from three "hits" being detected and awarded bonus points (if any) as a result of three duplicates among the drawn balls being detected.

Figure 2B:
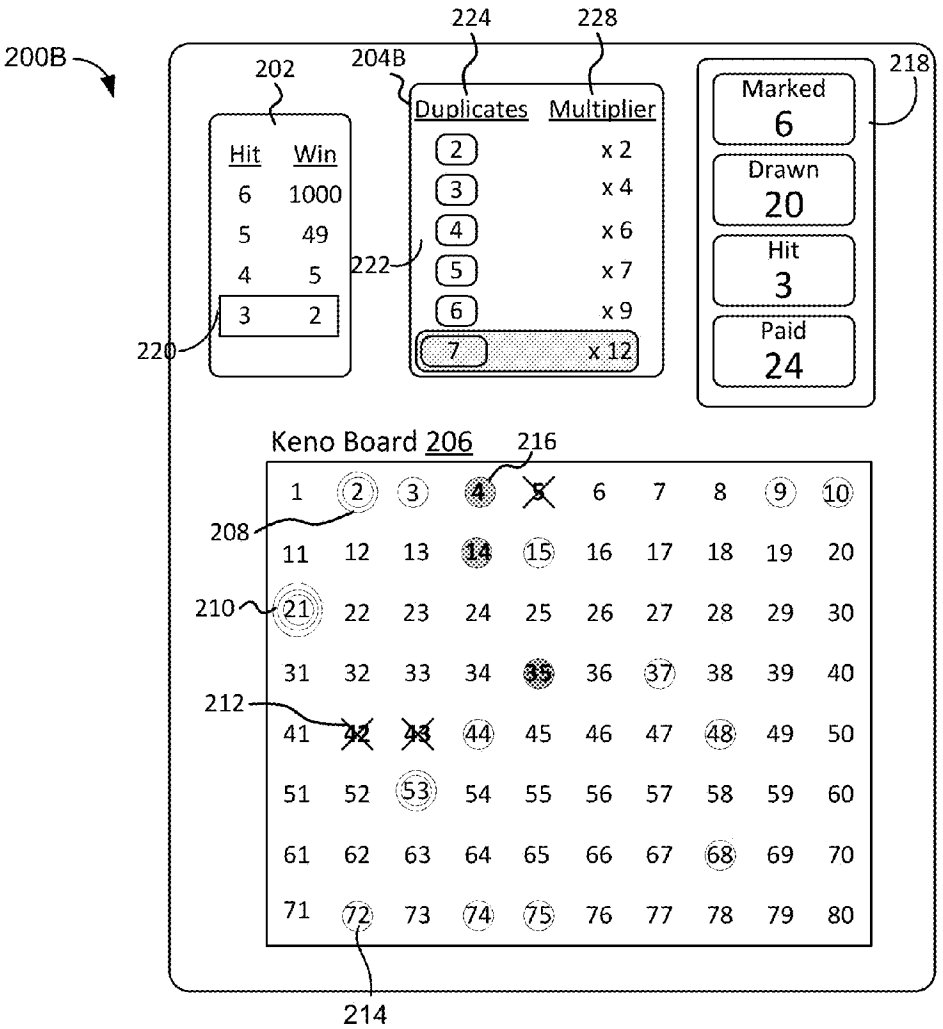

Now referring to FIG. 2B, the illustration 200B of the keno game is shown, which includes the display section 204B illustrating a paytable for awarding the player multipliers when duplicates are detected among the drawn balls. In particular, the display section 204B displays that for two detected duplicate drawn balls, a multiplier having a value "2" is awarded to the player. For a total of three detected duplicate drawn balls, a multiplier having a value "4" is awarded to the player, while for a total of four detected duplicated drawn balls, a multiplier having a value "6" is awarded, etc. As emphasized by the rectangle 222 around the last row of the paytable shown in the in the display sections 204B, seven duplicates were detected during the keno game, which resulted in the player being awarded a multiplier with a value of "12". Again, the number of duplicates in column 224 may go up to the number of drawn balls, with different multipliers for each.

The awarded multiplier may be applied to the win amount won by the player as shown in the display section 202. As a result, the player is awarded twenty four points as shown in the summary section 218 (i.e., two points awarded as shown in the display section 202 multiplied by the multiplier having a value of twelve). In some embodiments, the multiplier awarded to the player using a paytable may be applied to a number of points or credits awarded for the detection of duplicate drawn balls (e.g., to the bonus number of credits shown in the display section 204A).

Figure 2C:
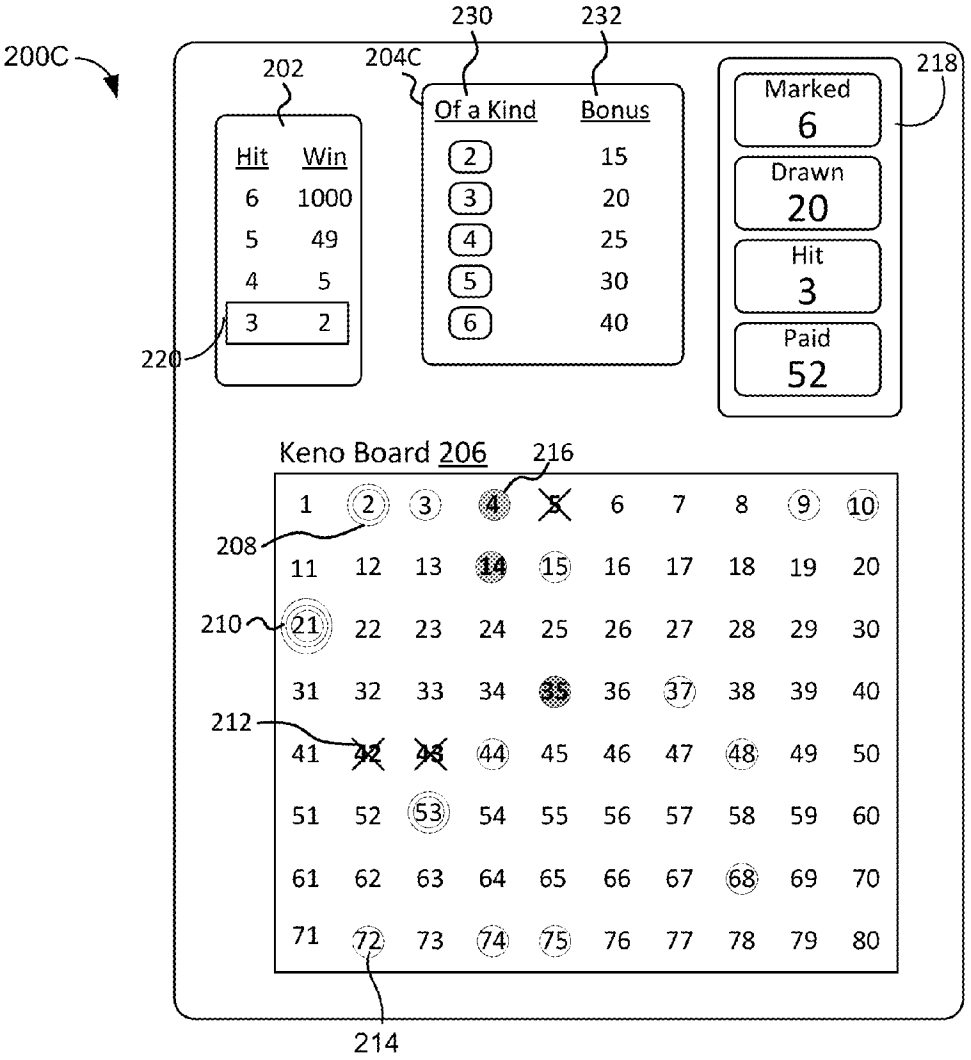

Now referring to FIG. 2C, the illustration 200C of the keno game includes a display section 204C, which illustrates a paytable for awarding the player additional points or credits when one or more "of a kind" drawn balls have duplicates. The display section 204C includes a "of a kind" column 230 showing the specific numbers of balls that have duplicates. As shown on the keno board 206, the ball labeled with number "2" was drawn twice, the ball labeled with number "53" was also drawn twice, while the ball labeled with number "21" was drawn three times. Accordingly, three balls "of a kind" (i.e., balls "2", "53" and "21") were drawn multiple times.

The display section 204C further includes a "bonus" column displaying the "bonus" number of credits. As shown on the keno board 206, three balls "of a kind" were drawn multiple times (i.e., balls "2", "53", and "21). As a result, the player is entitled to fifty bonus credits (i.e., fifteen credits for two balls numbered "2", fifteen credits for two balls numbered "53" drawn, and twenty credits for three balls numbered "21" drawn). As shown in the display section 218, the player is awarded a total of fifty two points which is a sum of the two points awarded from the three "hits" and fifty bonus credits.

Figure 2D:
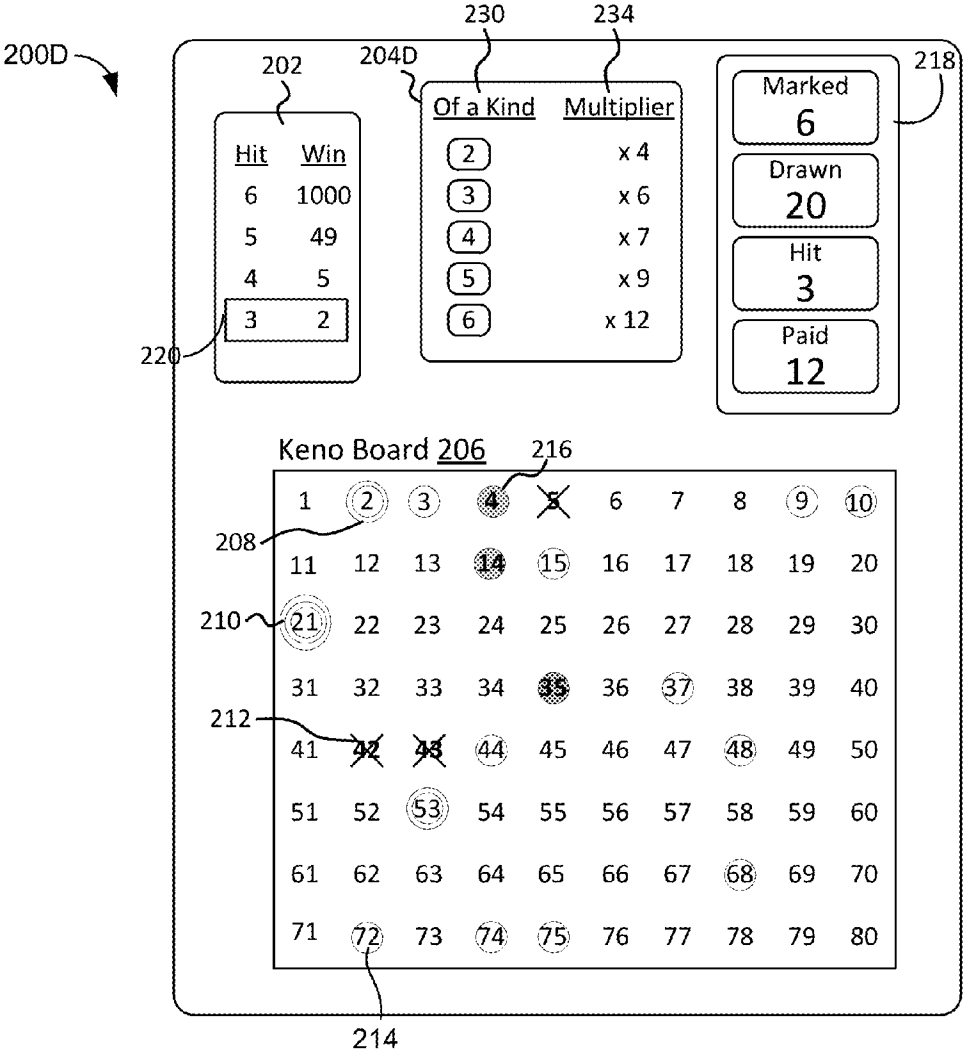

Similarly to FIG. 2C, FIG. 2D illustrates awarding the player additional points or credits when one or more "of a kind" drawn balls have duplicates. However, instead of awarding the player bonus points as illustrated in FIG. 2C, the player is awarded a multiplier as shown in a display section 204D of FIG. 2D. The display section 204D includes an "of a kind" column 230 showing the specific numbers of balls that have duplicates.

The display section 204D further includes a "multiplier" column displaying the "multiplier" values for various numbers of "of a kind" duplicate drawn balls. As shown on the keno board 206, three balls "of a kind" were drawn multiple times (i.e., ball numbered "2" was drawn twice, ball numbered "53" was drawn twice, and ball numbered "21" was drawn three times). As a result, the player is entitled to a multiplier having a value of "4" for the ball numbered "2" being drawn twice, a multiplier having a value of "4" for the ball numbered "53" being drawn twice, and a multiplier having a value of "6" for the ball numbered "21" being drawn three times. In some embodiments, the multiplier with the highest value is used to reward the player for the duplicates in the drawn balls. In these embodiments, the multiplier having value "6" is used, which results in twelve points awarded to the player as shown in the display section 218. In other embodiments, the multipliers are added together. For example, the multiplier "4", "4" and "6" are added together to arrive to a total multiplier value of "14". In this example, the total number of points awarded to the player is twenty eight (i.e., two points times the multiplier value of "14"). Other arrangements for combining multipliers may also be used. As another example, a multiplier having a value of "6" may be used on the basis that three sets (2's, 21's, and 53's) of "of a kind's were identified.

Although specific multiplier values are shown in the display section 204D for various numbers "of a kind" duplicate drawn balls, any multiplier may be used for any number "of a kind" duplicates. Displayed multipliers are shown for illustrative purposes only.

Figure 2E:
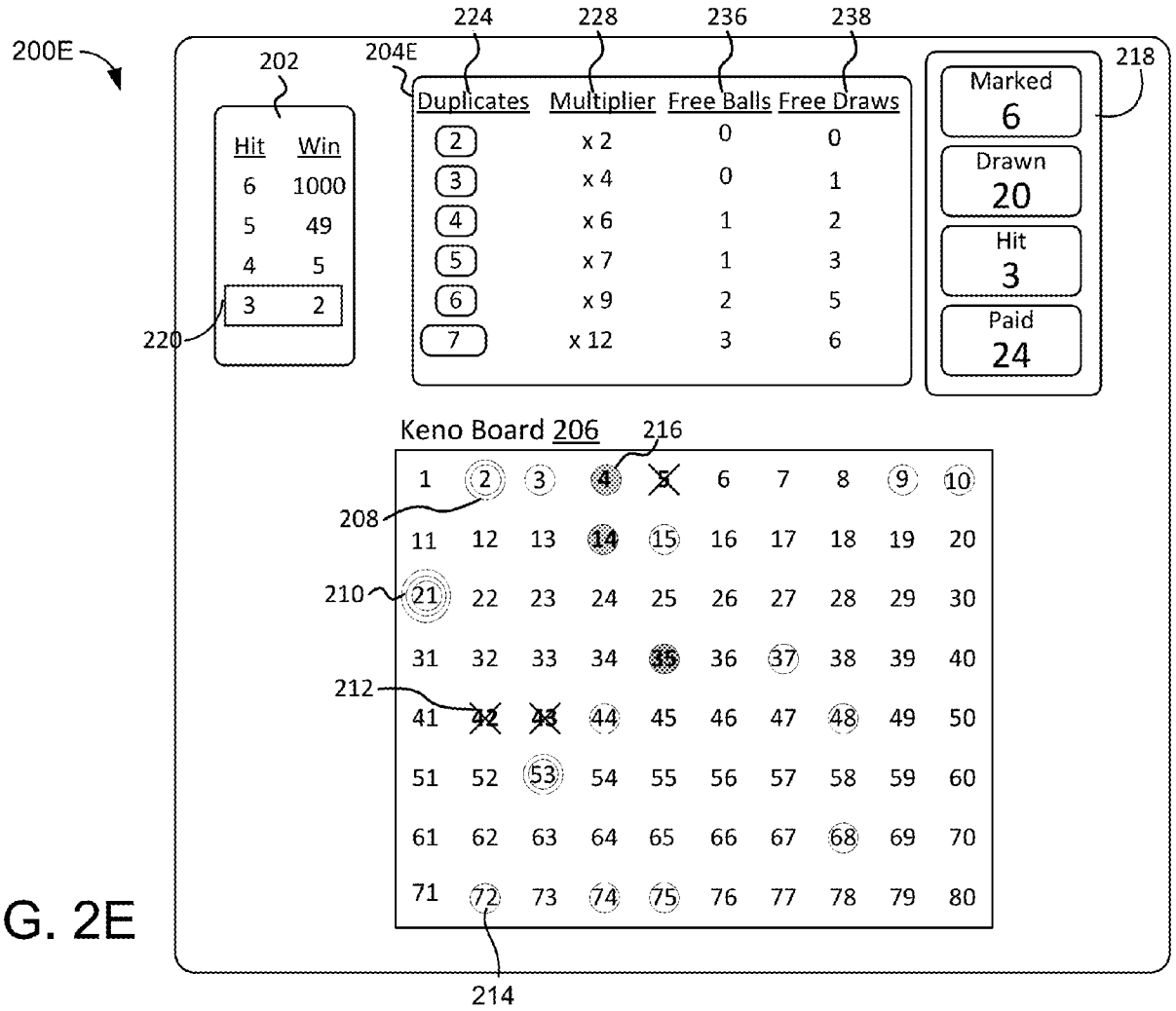

FIG. 2E provides the illustration 200E of the keno game including a display section 204E, which illustrates awarding the player a multiplier, as well as free balls and free draws when duplicate drawn balls are detected. As shown, the player may be awarded a combination of a multiplier, free balls, and free draws. In other embodiments, the player may be awarded any combination of additional points or credits, multipliers, free balls, free draws, and/or any other type of award when a certain number of duplicate drawn balls are detected. In some embodiments, for each number of duplicates detected, a different combination of awards may be awarded to the player. For example, when a total of two duplicate drawn balls are detected, only additional points may be awarded, while when a total of four duplicate drawn balls are detected, additional bonus points and additional free balls may be awarded.

As shown, the display section 204E includes the "duplicates" column 224 showing total numbers of duplicate drawn balls. Although not shown, an "of a kind" column (as shown in FIGS. 2C and 2D) may be included in addition to, or instead of, the "duplicates" column 224. The multiplier column 228 is shown in the display section 204E having various multiplier values. Although not shown, the "bonus" column 226 (as shown in FIGS. 2A and 2C) may be included in addition to, or instead of, the "multiplier" column 228. In addition to the "multiplier" column 228, a "free balls" column 236 and a "free draws" column 238 are displayed. The player may be awarded a particular number of additional free balls that the player may use to make additional markings on the keno board in the subsequent keno games and/or in the current keno game. The player may further be awarded a particular number of additional free draws (i.e., in addition to the twenty draws) that may be used in the current keno game and/or in subsequent keno games.

As shown in the display sections 204E and 218, for seven detected duplicate drawn balls on the keno board 206, the player is awarded a multiplier with a value of twelve which results in a total of twenty four points being awarded to the player. In addition, the player is awarded three free additional balls as well as six free additional draws.

Figure 3:
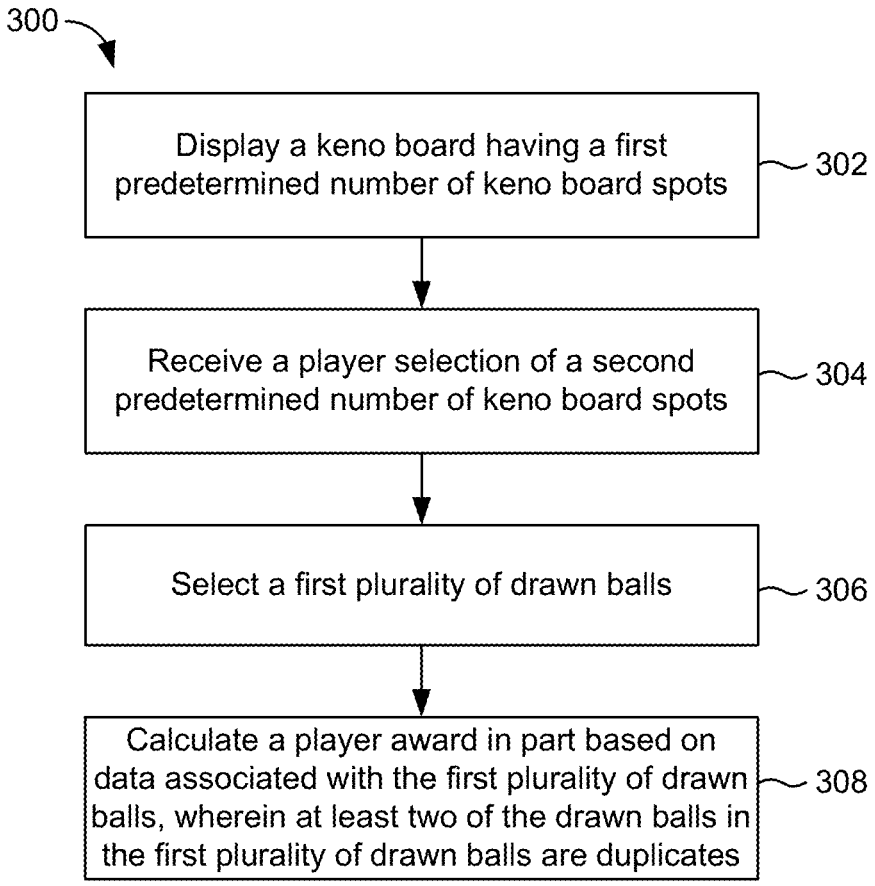
FIG. 3 is a flow diagram of a process for calculating payout during a keno game based on duplicate drawn balls, in an accordance with an example implementation.

FIG. 3 is a flow diagram of a process 300 for providing a keno game that allows for duplicate drawn balls in accordance with an illustrative embodiment. The process 300 can be implemented on a computing device (e.g., a gaming machine, a user device, etc.). In one embodiment, the process 300 is encoded on a computer-readable medium that contains instructions that, when executed by the computing device, cause the computing device to perform operations of the process 300.

The process 300 includes displaying (block 302) a keno board having a first predetermined number of keno board spots. In some embodiments, the first predetermined number of keno board spots may be equal to eighty spots. In these embodiments, the displayed keno board may be a ten by eight keno board, with each spot labeled with a number between one and eighty. In some embodiments, any other number of keno board spots may be displayed (e.g., fifty keno board spots, one hundred keno spots, etc.).

The process 300 further includes receiving (block 304) a player selection of a second predetermined number of keno board spots. The second predetermined number of keno board spots may be six or any other number. When using a touch screen device, the user may mark the keno spots by touching the keno board spots of interest on the touch screen. In another example, the user may mark the keno board spots by selecting the keno spots using the mouse indicator or by pressing buttons.

The process 300 further includes selecting (block 306) a first plurality of drawn balls. Some of the drawn balls (e.g., two or more) may be duplicates. The first plurality of drawn balls may include any number of drawn balls (e.g., twenty drawn balls). The drawn balls may be selected from a set of available drawing balls having a third predetermined number of balls (e.g., eighty balls). The drawn balls may be independently drawn with each ball being selected from a set of available balls numbered from one to eighty (or another value of the predetermined number of keno board spots) or from multiple sets of balls. Accordingly, one or more duplicate drawn balls may be selected. For example, two drawn balls labeled with number "2" may be selected.

In some embodiments, after each ball is selected from the set of available drawn balls, it is "put" back into the set of available draw balls. Accordingly, after a ball is selected from the set of available drawing balls, the ball remains in the set of available balls for further drawing. In some embodiments, the selection of each ball in the plurality of drawn balls from the set of available drawing balls is displayed such that after each ball is selected from the set of available drawing balls, a visualization of each ball selected from the set of available drawing balls being "put" back into the set of available drawing balls is provided. In other embodiments, each of the drawn balls may be drawn from a separate set of available drawing balls.

The process 300 further includes calculating (block 308) a player award in part based on data associated with the first plurality of drawn balls. The data associated with the first plurality of drawn balls can include a total number of duplicate drawn balls in the first plurality of drawn balls, in which case the player award may be calculated at least in part based on the total number of duplicate drawn balls in the first plurality of drawn balls and a predetermined award assigned to the total number of duplicate drawn balls. For example, if the number of drawn balls includes two duplicate drawn balls, then the award payout amount may be five credits (or any other number of credits).

The data associated with the first plurality of drawn balls can include a number of duplicate drawn balls for each unique drawn ball, in which case the player award can be calculated at least in part using predetermined awards assigned to each number of duplicates for each unique drawn ball. For example, if two drawn balls have value "21", while two other drawn balls have value "53", the player award may be a sum of an award for two duplicate drawn balls numbered "21" (e.g., 15 points) and an award for two duplicate drawn balls numbered "53" (e.g., 15 points).

The number of duplicates in the drawn balls may be used to award the player another type of award in addition to, or instead of, a payout. For example, any combination of the following awards may be awarded to the player based on the number of duplicate drawn balls including, but not limited to, multiplier for the base game, additional free balls, and additional free draws. Instead of, or in addition to, the total number of duplicates, a number "of a kind" duplicate drawn balls may be used to determine the award. The payout may further be determined based on the number of matches detected between player marked spots and drawn balls. The total payout may include the number of credits calculated based on the data associated with the duplicate ball draws, and the number of credits determined based on the number of detected "hits".

Figure 4:
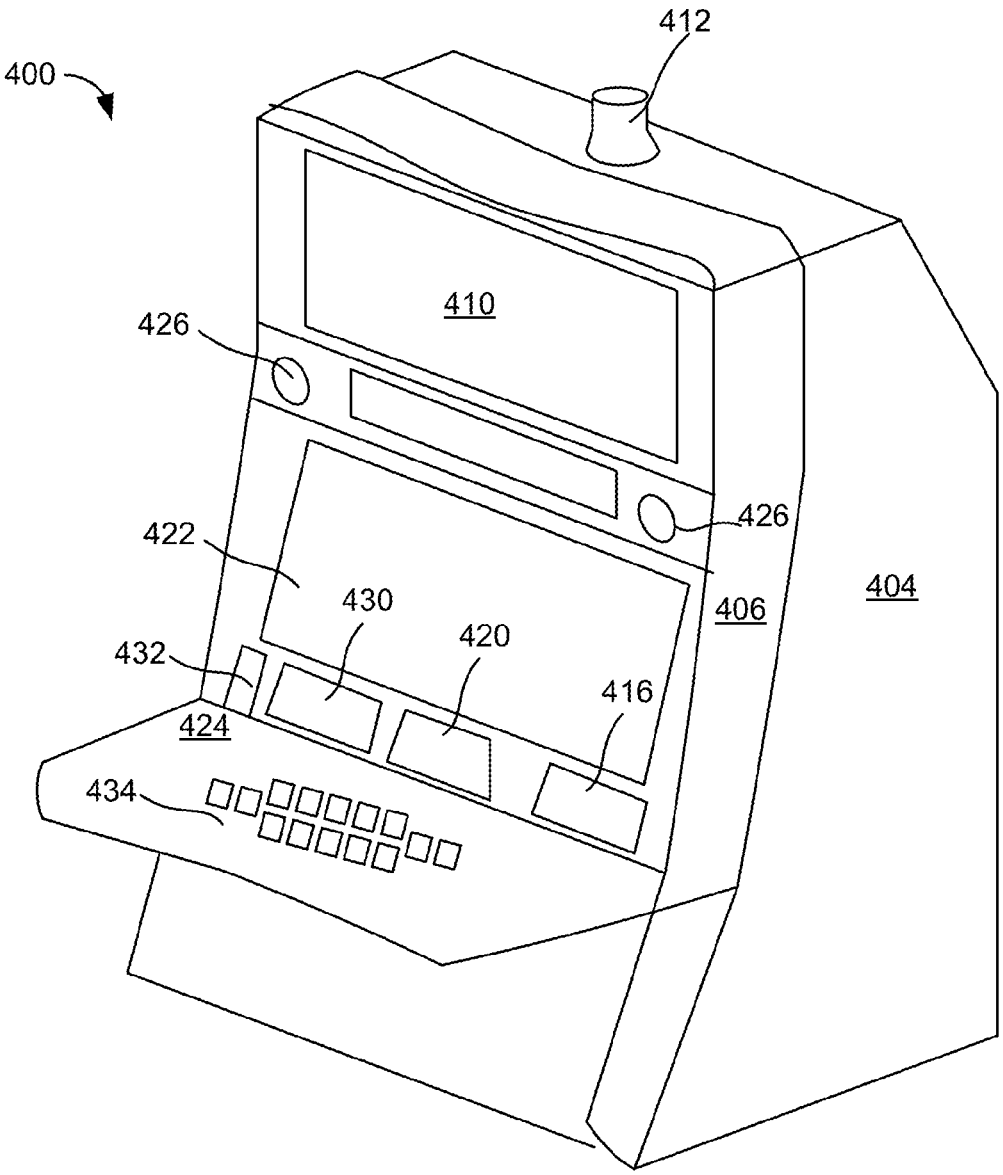
FIG. 4 is a diagram of an electronic gaming machine, in an accordance with an example implementation.

Referring to FIG. 4, a perspective drawing of an electronic gaming machine 400 is shown in accordance with described embodiments. The gaming machine 400 may include a main cabinet 404. The main cabinet 404 may provide a secure enclosure that prevents tampering with device components, such as a game controller (not shown) located within the interior of the main cabinet 404. The main cabinet 404 may include an access mechanism, such as a door 406, which allows the interior of the gaming machine 400 to be accessed. Actuation of the door 406 may be controlled by a locking mechanism. In some embodiments, the locking mechanism, the door 406, and the interior of main cabinet 404 may be monitored with security sensors of various types to detect whether the interior has been accessed. For instance, a light sensor may be provided within the main cabinet 404 to detect a change in light-levels when the door 406 is opened and/or an accelerometer may be attached to the door 406 to detect when the door 406 is opened.

The gaming machine 400 may include any number of user interface devices that convey sensory information to a user and/or receive input from the user. For example, the gaming machine 400 may include electronic displays 440 and/or 422, speakers 426, and/or a candle device 412 to convey information to the user of the gaming machine 400. The gaming machine 400 may also include a console 424 having one or more inputs (e.g., buttons, track pads, etc.) configured to receive input from a user. In one embodiment, the display 410 and/or the display 422 may be a touch screen display configured to receive input from a user. A controller (not shown) within the gaming machine 400 may run a game, such as a wager-based game (e.g., a keno game), in response to receiving input from a user via inputs located in the console 424, display 422, or display 410. For example, inputs located in the console 424 may be operated to place a wager in the game and to run the game. In response, the controller may cause the display 422 to show a wager-based game such as a keno game.

The gaming machine 400 may also include devices for conducting a wager-based game. For example, the gaming machine 400 may include a ticket acceptor 416 and a printer 420. In various embodiments, the gaming machine 400 may be configured to run on credits that may be redeemed for money and/or other forms of prizes. The ticket acceptor 416 may read an inserted ticket having one or more credits usable to play a game on the gaming machine 400. For example, a player of the gaming machine 400 may wager one or more credits within a video keno game. If the player loses, the wagered amount may be deducted from the player's remaining balance on the gaming machine 400. However, if the player wins and is awarded an award, the player's balance may be increased by the amount won and/or awarded. Any remaining credit balance on the gaming machine 400 may be converted into a ticket via the printer 420. For example, a player of the gaming machine 400 may cash out of the machine by selecting to print a ticket via the printer 420. The ticket may then be used to play other gaming machines or redeemed for cash and/or prizes. According to various embodiments, the gaming machine 400 may record data regarding its receipt and/or disbursement of credits.

In one embodiment, the gaming machine 400 may include a loyalty card acceptor 430. In general, a loyalty card may be tied to a user's loyalty account. A loyalty account may store various information about the user, such as the user's identity, the user's gaming preferences, the user's gaming habits (e.g., which games the user plays, how long the user plays, etc.), or similar information about the user. A loyalty account may also be used to reward a user for playing the gaming machine 400. For example, a user having a loyalty account may be given an award turn on the gaming machine 400 or credited loyalty points for playing the gaming machine 400. Such loyalty points may be exchanged for loyalty rewards (e.g., a free meal, a free hotel stay, free room upgrade, discounts, etc.).

Implementations of the subject matter and the operations described in this specification can be implemented in digital electronic circuitry, computer software, firmware or hardware, including the structures disclosed in this specification and their structural equivalents or in combinations of one or more of them. Implementations of the subject matter described in this specification can be implemented as one or more computer programs, i.e., one or more modules of computer program instructions, encoded on one or more computer storage medium for execution by, or to control the operation of data processing apparatus. Alternatively or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, or other storage devices). Accordingly, the computer storage medium may be tangible and non-transitory.

The operations described in this specification can be implemented as operations performed by a data processing apparatus on data stored on one or more computer-readable storage devices or received from other sources.

The term "client or "server" includes a variety of apparatuses, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application-specific integrated circuit). The apparatus can also include, in addition to hardware, a code that creates an execution environment for the computer program in question, e.g., a code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, or a portable storage device (e.g., a universal serial bus (USB) flash drive). Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented on a computer having a display device, e.g., a CRT (cathode ray tube), LCD (liquid crystal display), OLED (organic light emitting diode), TFT (thin-film transistor), plasma, other flexible configuration, or any other monitor for displaying information to the user and a keyboard, a pointing device, e.g., a mouse, trackball, etc., or a touch screen, touch pad, etc., by which the user can provide input to the computer. Other kinds of devices can be used to provide for interaction with a user as well. For example, feedback provided to the user can be any form of sensory feedback, e.g., visual feedback, auditory feedback, or tactile feedback and input from the user can be received in any form, including acoustic, speech, or tactile input. In addition, a computer can interact with a user by sending documents to and receiving documents from a device that is used by the user. For example, by sending webpages to a web browser on a user's client device in response to requests received from the web browser.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown, in sequential order or that all illustrated operations be performed to achieve desirable results. In certain circumstances, multitasking and parallel processing may be advantageous. Moreover, the separation of various system components in the implementations described above should not be understood as requiring such separation in all implementations and it should be understood that the described program components and systems can generally be integrated together in a single software product or packaged into multiple software products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing may be utilized.

What is claimed is:

1. A method of operating a gaming system, the method comprising:

receiving, by an acceptor, a physical item associated with a monetary value;

establishing, by at least one processor, a credit balance for a player based at least in part on the monetary value;

displaying, by at least one display device, a keno board having a first predetermined number of keno board spots each associated with one of a set of a plurality of different symbols;

receiving, by an input device, a player selection of a second predetermined number of the plurality of different symbols of the set to form a player set of symbols;

receiving an actuation of a wager button and placing, by the at least one processor, a wager in response to the received actuation of the wager button, the credit balance being decreasable by the wager;

randomly selecting, by the at least one processor, a first plurality of the plurality of different symbols of the set to form a gaming system set of symbols, wherein at least one of the plurality of different symbols of the set can be selected more than once; and determining, by the at least one processor, a player award in part based on: (1) a quantity of symbols in the player set of symbols that match one of the symbols in the gaming system set of symbols; and (2) a quantity of the symbols in the gaming system set of symbols that are duplicates, the credit balance being increasable based on any determined player award; and receiving an actuation of a cashout button and initiating, by the at least one processor, a payout associated with the credit balance in response to the received actuation of the cashout button.

2. The method of claim 1, wherein after one of the plurality of different symbols is selected from the set, the symbol remains in the set of the plurality of different symbols for further drawings.

3. The method of claim 2, further comprising displaying, by the at least one display device, the selection of each symbol in the gaming system symbol set, wherein after each symbol is selected from the set of the plurality of different symbols, a visualization of each symbol selected from the set of the plurality of different symbols being put back into the set of the plurality of different symbols is displayed.

4. The method of claim 1, which includes determining, by the at least one processor, the player award in part based on a total number of duplicate symbols in the gaming system set of symbols and a predetermined award assigned to the total number of duplicate symbols.

5. The method of claim 1, which includes determining, by the at least one processor, the player award in part based on a number of duplicate symbols for each unique symbol, and predetermined awards assigned to each number of duplicates for each unique symbol.

6. The method of claim 1, wherein the player award includes a payment amount.

7. The method of claim 1, wherein the player award is calculated using at least one multiplier.

8. The method of claim 1, wherein the player award includes one or more additional random symbol selection for the gaming system symbol set.

9. The method of claim 1, wherein the player award includes one or more additional player symbol selections.

10. An electronic gaming device comprising:

a housing;

a display supported by the housing and configured to display a keno game to a player, the keno game having a keno board with a first predetermined number of keno board spots each associated with one of a set of a plurality of different symbols;

a user-input panel supported by the housing;

an acceptor supported by the housing; and a game controller having one or more data processors and one or more storage devices storing instructions that, when executed by the one or more data processors, cause the one or more data processors to:

establish a credit balance for a player based at least in part on a monetary value after the acceptor receives a physical item associated with the monetary value;

display the keno board;

receive a player selection of a second predetermined number of the plurality of different symbols of the set to form a player set of symbols;

place a wager after receiving an actuation of a wager button, the credit balance being decreasable by the wager;

randomly select a first plurality of the plurality of different symbols from the set, wherein after a symbol is selected from the set, the symbol remains in the set for further drawings;

determine a player award in part based on: (1) a quantity of symbols in the player set of symbols that match one of the symbols in the gaming system set of symbols; and (2) a quantity of the symbols in the gaming system set of symbols that are duplicates, the credit balance being increasable based on any determined player award; and initiate a payout associated with the credit balance after receiving an actuation of a cashout button.

11. The electronic gaming device of claim 10, wherein the instructions, when executed by the one or more data processors, cause the one or more data processors to operate with the display to display the selection of each symbol in the gaming system symbol set, wherein after each symbol is selected from the set of the plurality of different symbols, a visualization of each symbol selected from the set of the plurality of different symbols being put back into the set is displayed.

12. The electronic gaming device of claim 10, wherein the instructions, when executed by the one or more data processors, cause the one or more data processors to determine the player award in part based on a total number of duplicate symbols in the gaming system set of symbols and a predetermined award assigned to the total number of duplicate symbols.

13. The electronic gaming device of claim 10, wherein the instructions, when executed by the one or more data processors, cause the one or more data processors to determine the player award in part based on a number of duplicate symbols for each unique symbol, and predetermined awards assigned to each number of duplicates for each unique symbol.

14. The electronic gaming device of claim 10, wherein the player award includes a payment amount.

15. The electronic gaming device of claim 10, wherein the player award is calculated using at least one multiplier.

16. The electronic gaming device of claim 10, wherein the player award includes one or more free random symbol selections for the gaming system symbol set.

17. The electronic gaming device of claim 10, wherein the player award includes one or more additional player symbol selections.

18. A non-transitory computer-readable storage medium having machine instructions stored therein, the instructions being executable by a processor to cause the processor to:

establish a credit balance for a player based at least in part on a monetary value after an acceptor receives a physical item associated with the monetary value;

cause a display device to display a keno board having a first predetermined number of keno board spots each associated with one of a set of a plurality of different symbols;

operate with an input device to receive a player selection of a second predetermined number of the plurality of different symbols of the set to form a player set of symbols;

place a wager after an actuation of a wager button is received, the credit balance being decreasable by the wager;

randomly select a first plurality of the plurality of different symbols of the set to form a gaming system set of symbols, wherein after a symbol is selected from the set, the symbol remains in the set for further drawings;

determine a player award in part based on: (1) a quantity of symbols in the player set of symbols that match one of the symbols in the gaming system set of symbols; and (2) a quantity of the symbols in the gaming system set of symbols that are duplicates, the credit balance being increasable based on any determined player award; and initiate a payout associated with the credit balance after an actuation of a cashout button is received.

19. The non-transitory computer-readable storage medium of claim 18, wherein the instructions, when executed by the processor, cause the processor to determine the player award in part based on a total number of duplicate symbols in the gaming system symbol set and a predetermined award assigned to the total number of duplicate symbols.

20. The non-transitory computer-readable storage medium of claim 18, wherein the instructions, when executed by the processor, cause the processor to cause the display to display the selection of each symbol in the gaming system symbol set, wherein after each symbol is selected from the set of the plurality of different symbols, a visualization of each symbol selected from the set being put back into the set is displayed.

* * * * *